US006969275B1

(12) United States Patent
Brock

(10) Patent No.: US 6,969,275 B1
(45) Date of Patent: Nov. 29, 2005

(54) CORD RETRACTOR FOR COSMETOLOGY APPLIANCE

(76) Inventor: Dwight L. Brock, 209 Dunn Rd., Unit A, Fayetteville, NC (US) 28301

( * ) Notice: Subject to any disclaimer, the term of this patent is extended or adjusted under 35 U.S.C. 154(b) by 4 days.

(21) Appl. No.: 10/906,245

(22) Filed: Feb. 10, 2005

(51) Int. Cl.[7] ..... H01R 11/00
(52) U.S. Cl. ..... 439/502
(58) Field of Search ..... 439/501–502, 439/4, 27, 369, 20–22; 174/67, 53, 47–48, 174/50, 66, 135; 320/25–26, 48, 2–6; 206/825; 191/12.4, 12.2 R

(56) References Cited

U.S. PATENT DOCUMENTS 5,214,368 A * 5/1993 Wells ..... 320/105
5,379,903 A * 1/1995 Smith ..... 211/26
5,701,981 A * 12/1997 Marshall et al. ..... 191/12.4
5,723,815 A * 3/1998 Pena ..... 174/53
5,773,757 A * 6/1998 Kenney et al. ..... 174/53
5,848,701 A * 12/1998 Riccabona ..... 206/702
6,095,156 A 8/2000 Smith, II ..... 132/286
6,331,121 B1 12/2001 Raeford, Sr. ..... 439/501
6,591,952 B1 7/2003 Randall ..... 191/12.4

* cited by examiner

*Primary Examiner*—J. F. Duverne
(74) *Attorney, Agent, or Firm*—Mills Law Firm PLLC

(57) ABSTRACT

A cord organizer for cosmetology tools at a work station includes a cord retractor mounted on the work station to which the existing cord of an appliance may be connected without modification at an exterior receptacle on the rotating portion of the retractor housing. A locking grommet between the cord and the slot prevents movement forces on the electrical connection during extension and retraction. The housing further includes a wide angle extended circumferential opening that allows operator observation of the cord condition and increased cord mobility during use.

10 Claims, 5 Drawing Sheets

CORD RETRACTOR FOR COSMETOLOGY APPLIANCE

FIELD OF THE INVENTION

The present invention relates generally to cord organizing systems, and, in particular, to a cord organizer for extending and retracting the power cords on hair care appliances at a cosmetology work station.

BACKGROUND OF THE INVENTION

Barbers, stylists, and other professionals in the cosmetology and hair care service business use a wide variety of manual and electrical tools during the course of the day. All equipment is generally restricted to a confined area, oftentimes a countertop or a cabinet with a limited workspace. Because of such space limitations, the electrical tools are hung on brackets or hooks with the cords connected at a power strip. Over the course of a workday, the cord can become entangled, twisted or pulled from the electrical outlet, or dislodged from the storage location and damaged. The cords are generally lengthy, contacting the dust and hair on the floor. To maintain an orderly and efficient work area, it is necessary throughout the day to disentangle and rearrange the cords for unimpeded access to the desired tool.

Recognizing the foregoing problems, a number of approaches for managing the cords of styling, drying and clipping tools used in the trade have been proposed. None, however, fully address the needs of the workplace and operator, and do not appear to be commercially available.

For example, U.S. Pat. No. 5,379,903 to Smith discloses a custom enclosure having internal cord retractors, each of which has a power cord that is adapted for rewiring into existing barber clippers. In addition to being large and cumbersome for incorporation into most limited workspaces, the layout is not compatible with current hair styling equipment such as blowers, curling irons and the like. Further, the electrical approvals required for sale would not be satisfied by the generic proposal for interfacing with the existing barber tools. Each tool requires a defined termination to provide safe and dependable operation, including a strain relief at the tool inlet and terminations meshing with the internal hardware.

U.S. Pat. No. 6,331,121 to Raeford also discloses a custom housing having custom internal retractors. To overcome the above limitation on rewiring the appliance, the existing power cord plug is attached to a conventional electrical socket on the retractor. This presents problems when the tool cord is extended. If overextended, the cord is likely to separate from the socket, disabling the tool and requiring lengthy disassembly of the housing for reconnection. The apparatus would require approval before sale or use and is not known to be currently marketed.

U.S. Pat. No. 6,095,156 to Smith discloses a wheeled cart having a cabinet provided with cord retractors that have conventional, axially separable plug and socket connections with the standard appliance cords. To provide for retraction of the standard appliance cord, the connection must be established in the tensioned state establishing an initial loading thereon promoting separation. In such state, inadvertent actuation of the retractor prior to connection can cause rotation to the retracted state thus frustrating operation until repair.

The foregoing limitations were effectively overcome the cosmetology work station disclosed in my copending application, U.S. patent application Ser. No. 10/835,194 filed on Apr. 29, 2004 and entitled "Cord Organizer For Cosmetology Work Station". Therein a method and apparatus were provided for controlling the cord lengths of appliances at a work station using approved and proven electrical and mechanical components that could be readily incorporated at existing locations with existing tools, allowing the extension and retraction of the power cords without risk of separation. There are instances in this field wherein physically altering the appliance cords is a disadvantage. The work force is somewhat fluid, with personnel changing employment over the course of their career and accordingly unwilling to effect a cord modification that might not be directly usable at the next site. Similarly, a location change within the existing site might not be able to accommodate the modified appliance.

Therefore, it would be desirable to retain the benefits of my prior apparatus while allowing personnel to use their appliances without modification. U.S. Pat. No. 6,591,952 to Randall discloses a housing with internal retractors having radial sockets into which the power cords are conventionally inserted. Randall, however, does not meet current regulatory requirements. First, prevailing regulations require that plug-in type connections cannot be enclosed or covered to avoid situations where the plug loosens from the receptacle. In Randall, the centripetal forces on the plug during winding creates such a separating potential, and resultant arcing and possible fire. Further, the cord should be visible in use and storage so that wear and tear can be assessed prior to shorting or other electrical failure. The Randall device establishes both the electrical connection and the retracted cord behind a cover assembly and thus at variance with regulations.

SUMMARY OF THE INVENTION

The present invention provides a cord retractor for mounting at a cosmetology work station whereat existing appliances may be connecting using the original cord without modification by plugging the cord into a receptacle carried on the rotating portion of the retractor housing, inserted through mating radial slots in the housing and cord reel, and wound about the reel with the retracting mechanism. A locking grommet between the cord and slot prevents movement forces on the electrical connection during extension and retraction. The housing further includes a wide angle extended circumferential opening that allows operator observation of the cord condition and increased cord mobility during use.

Accordingly, the invention provides a cord retractor for electrical cords of appliances usable without modification of the appliance cords and in conformity with prevailing electrical regulations

DESCRIPTION OF THE DRAWINGS

The above and other features and advantages of the invention will become apparent upon reading the following detailed description taken in conjunction with the accompanying drawings in which.

DETAILED DESCRIPTION OF THE PREFERRED EMBODIMENTS

Figure 1:
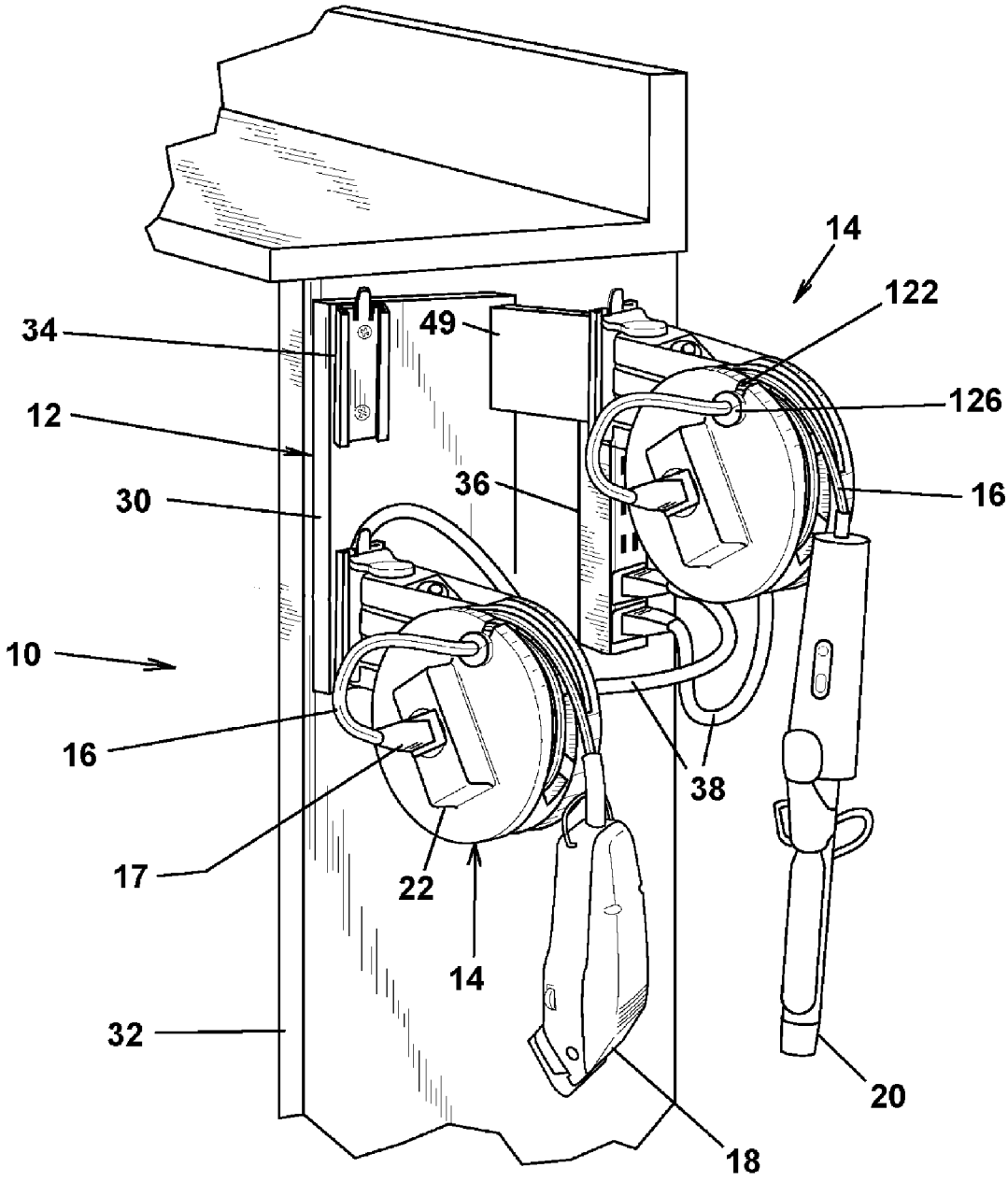
FIG. 1 is a perspective view of the cord retractors in accordance with an embodiment of the invention mounted on a work station.

Referring to the drawings, FIG. 1 shows a cosmetology work station 10 having a cord organizer 12 carrying a pair of cord retractors 14 for organizing and controlling the lengths of the electrical power cords 16, having plugs 17, of cosmetology hair care appliances including, without limitation, a razor 18 and a curling iron 20. When not in use the appliances may be stored directly on the cord retractor in the illustrated retracted cord position or on conventional accessories such as brackets, support sleeves, hooks or the like. The cord retractors allow personnel to use their existing equipment without modification.

Figure 3:
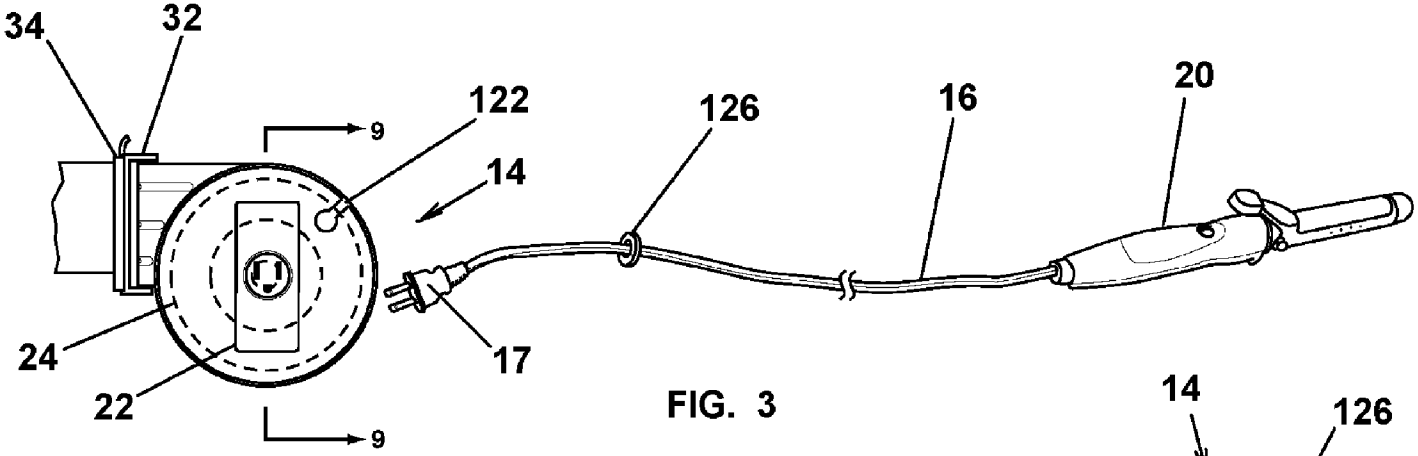
FIG. 3 is a side view of the cord retractor of FIG. 1 and a cosmetology appliance before connection.
Figure 4:
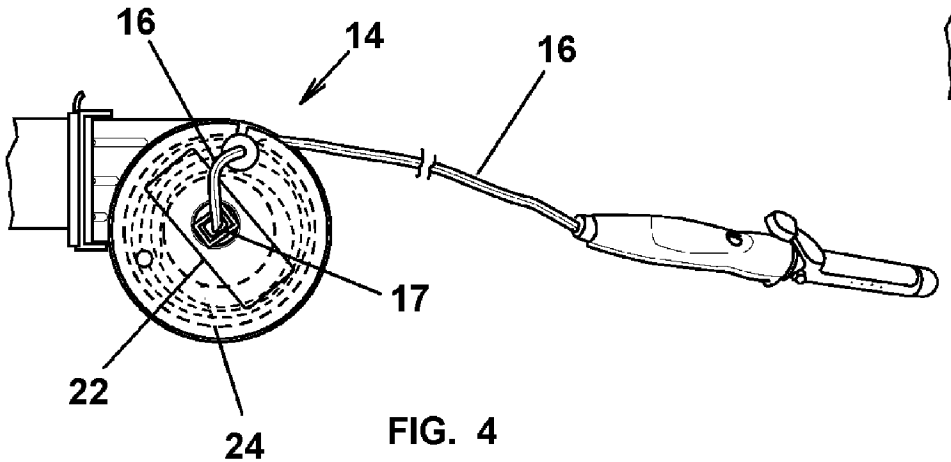
FIG. 4 is a side view of the cord retractor connected to the cosmetology appliance in the extended position.
Figure 5:
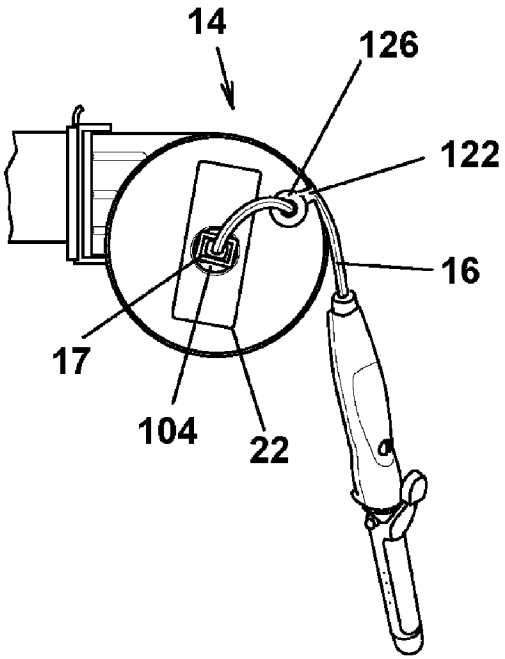
FIG. 5 is a side view of the cord retractor with the cosmetology appliance in the retracted position.
Figure 6:
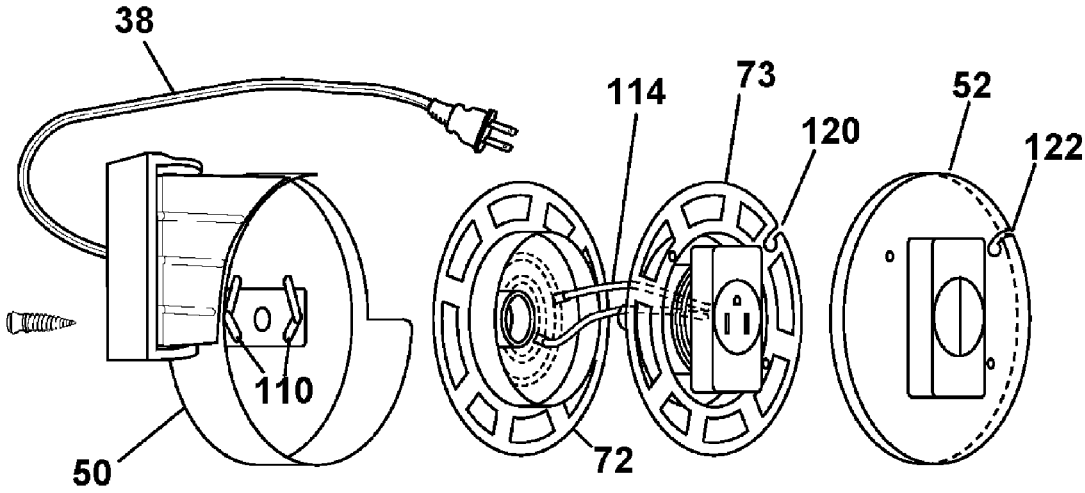
FIG. 6 is a right side exploded perspective view of the cord retractor.
Figure 7:
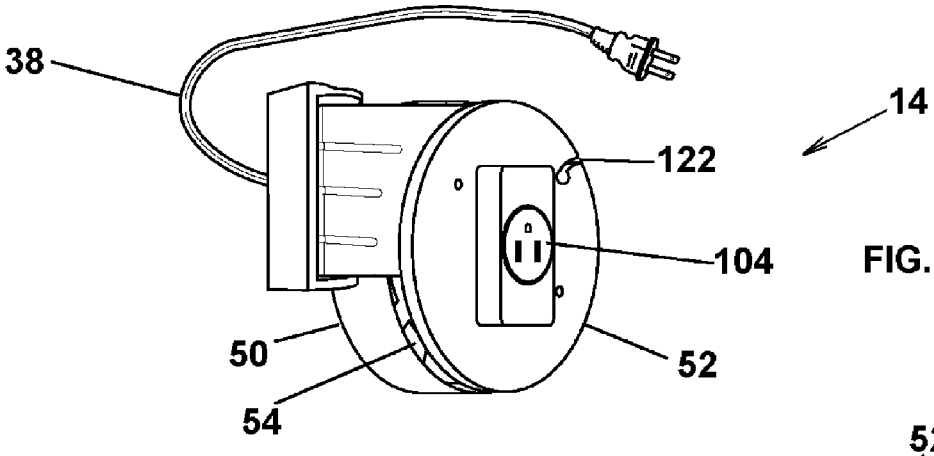
FIG. 7 is a right side assembled view of the cord retractor.
Figure 8:
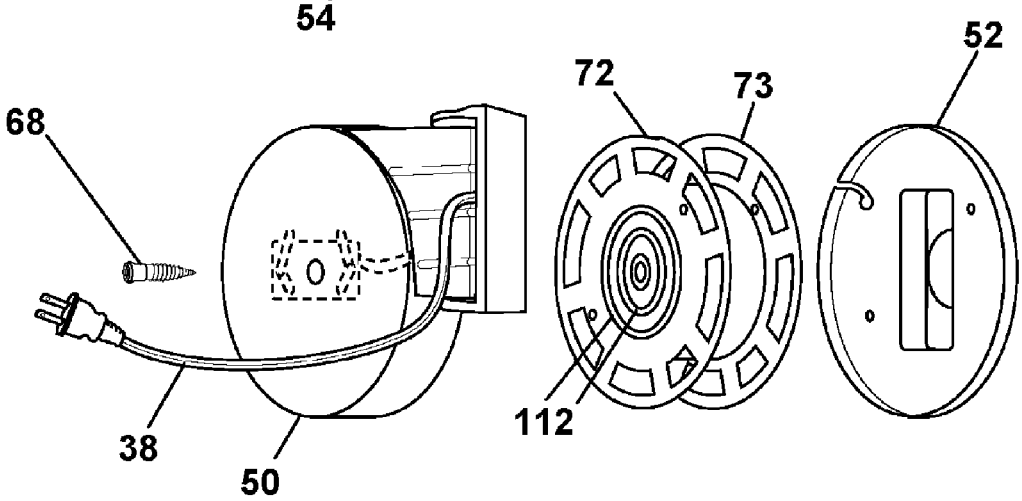
FIG. 8 is a left side exploded perspective view of the cord retractor.

As shown in FIGS. 3 through 5, the plug 17 of the cord 16 is connected into exposed outlet assembly 22 on one end face of the retractor 14, wrapped around a retractor reel 24, and extended to an operative position or retracted to a parked retracted position.

Referring to FIG. 1, the cord organizer 12 comprises a rectangular mounting base 30 attached to a side panel 32 of the work station 10, a plurality of the cord retractors 14 carried on mounting slides 34, and a conventional power strip 36 having sockets for receiving the plugs of the input cords 38 to the retractors 14.

The retractors 14 as modified for the purposes of the present invention may be based on commercially available, UL approved electrical devices. A suitable retractor for use and modification in the invention is Pro-Reel, model number 700 AR available from Alert Manufacturing Inc. of Bedford, Ohio. Suitable power strips, also UL approved, are widely commercially available from a variety of manufacturers.

Figure 2:
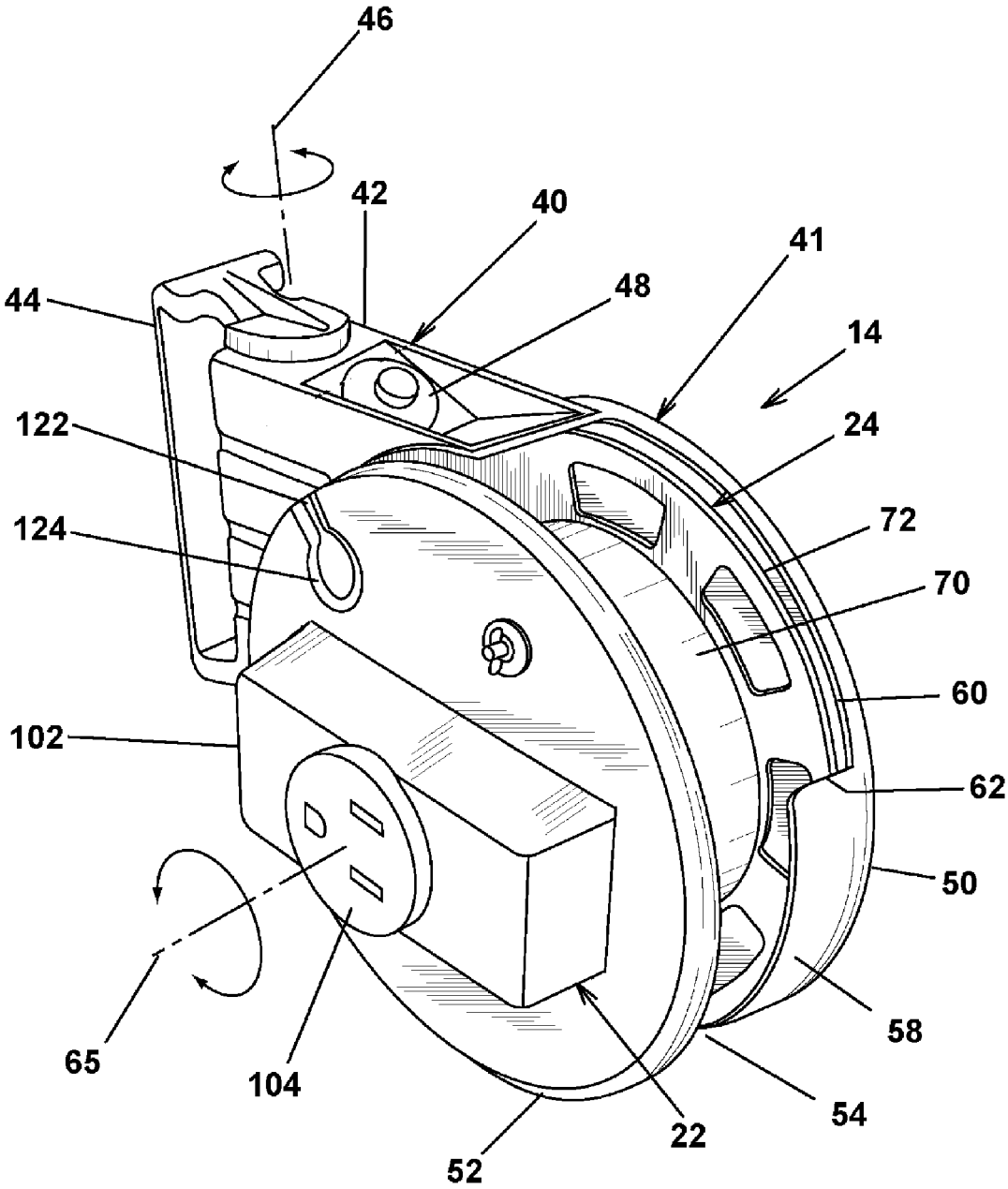
FIG. 2 is a front perspective view of the cord retractor of FIG. 1.

Referring to FIG. 2, each retractor 14 includes a base assembly 40 including a two-piece cylindrical reel housing 41 rotatably carrying the retractor reel 24. As described briefly below, a conventional releasable latching mechanism serves to maintain the appliance cord length at extended positions. Upon a slight forward pull on the cord, the latching mechanism is released and the extended cord is coiled onto the spool by spring biasing.

The base assembly 40 includes a rearward generally rectangular support arm 42 that is pivotally connected to a mounting bracket 44 for rotation about a vertical axis 46 thereby allowing the retractor to pivot freely in response to appliance cord direction and reducing stress on the cord. The mounting bracket 44 is adapted to be downwardly telescopically received on the mounting slide 34 to a retained detented mounting position. A circuit breaker 48 is mounted on the arm 42 for controlling power to the appliance. It will be readily apparent that a fixed mounting assembly may be used. To provide lateral spacing, one of the retractors may be mounted to the base 30 by a spacer block 49 (FIG. 1).

Figure 9:
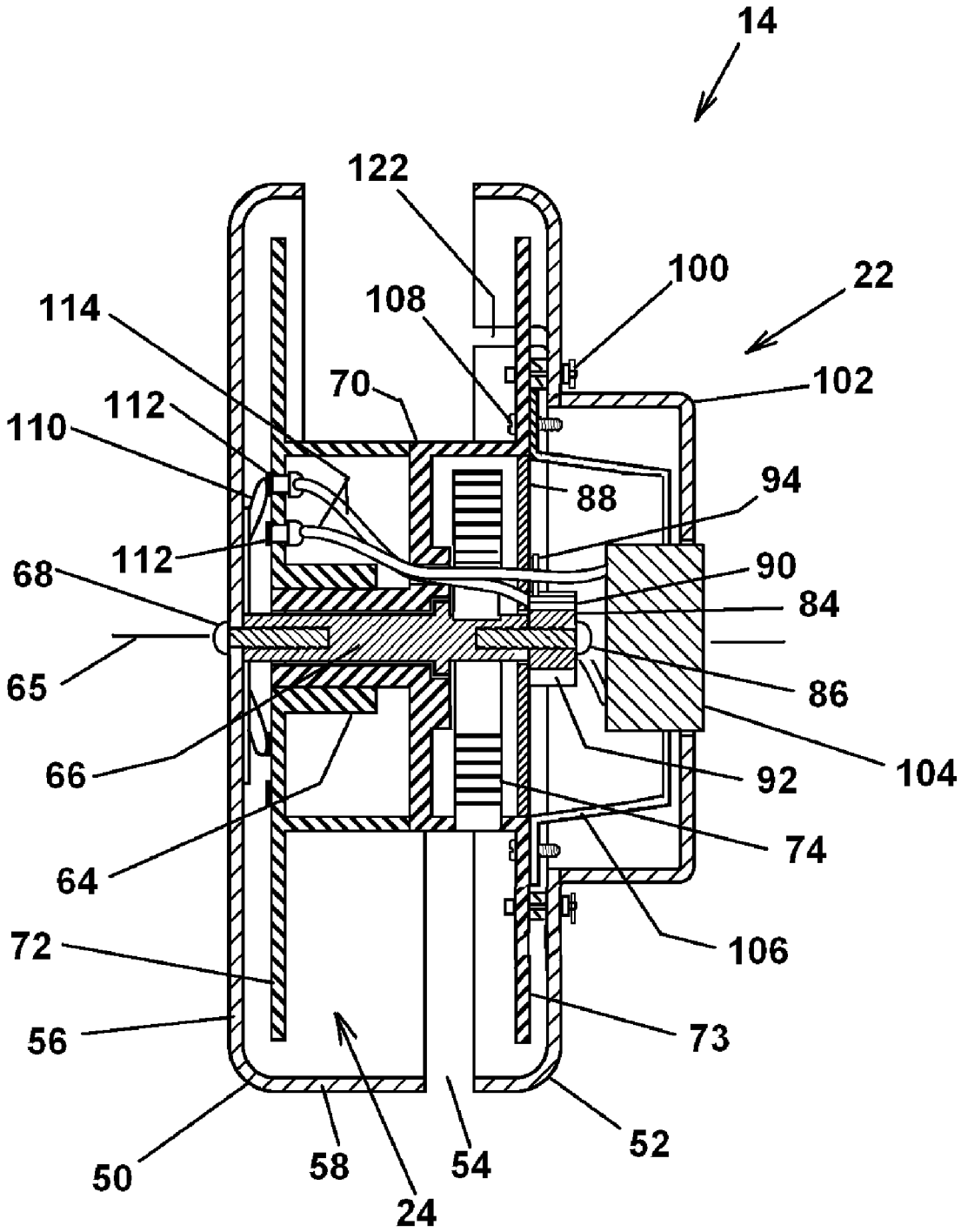
FIG. 9 is a cross section view of the cord retractor taken along line 9—9 in FIG. 3.

Referring to FIGS. 2 and 9, the reel housing comprises a fixed housing member 50 connected to the support arm 42, and a rotating housing member 52 carried on the retractor reel 24. The housing members 50 and 52 are axially spaced to form a wide angle circumferential opening 54 for installing and monitoring the condition of the appliance cord 16. The opening spans a sector of about 270° between a upper vertical frontal end adjacent the top of the arm 42, and a lower horizontal rearward end adjacent the bottom of the arm. The housing member 50 includes a circular end wall 56 and a circumferential side wall 58. A notch 60 is formed in the upper frontal quadrant of the side wall 58 frontally terminating at a horizontal support ledge 62. The notch 60 and adjacent slot 54 form an enlarged opening for withdrawing the appliance cord without interference, with the ledge 62 supporting the appliance and cord in the retracted position.

As shown in FIG. 9, the retractor reel 24 is a two-piece interfitted assembly having a center cylindrical hub assembly 64 rotatably supported about a horizontal axis 65 on a pivot shaft 66 fixedly connected centrally at the end wall of housing member 50 by fastener 68. The reel 24 includes an outer cylindrical hub 70 bounded by axially spaced annular end walls 72, 73 defining an outwardly opening circumferential groove for carrying the appliance cord in assembly. A coiled torsion spring 74 is carried in a counterbore recess between the hub 70 and the pivot shaft 66. The outer free end of the spring 74 is fixed to the hub 70 and the inner free end is fixed to the shaft 66. Upon extension of the cord in use and rotation of the retractor wheel, the spring 74 is increasingly coiled to develop a biasing for retracting the cord in the retraction mode.

The retractor reel 24 is provided with a latching assembly for providing detented extension positions for the cord and to permit rewinding of the reel with the biasing of the coiled torsion spring 74. The latching assembly includes a detent wheel 84 attached to the end of the shaft 66 by fastener 86 and a latching plate 88 rotatably carried by the wheel. The detent wheel 84 includes a toothed sector 90 and a notched sector 92. The latching plate 88 includes a pivotally mounted, spring biased pawl 94. The pawl 94 is biased into engagement at the notched sector 92 to establish a locked condition. Upon forward movement of the cord, the pawl 94 indexes to the notched sector, whereupon release of the cord allows rewinding to the retracted position, or the retraction slowed sufficiently to allow the pawl to engage again the notched sector.

The housing member 52 is rotatably attached to the side wall of the reel 24 by fasteners 100. The end wall of the housing member 52 carries the receptacle assembly 22 for electrically connecting the appliance. The receptacle assembly 22 includes a domed end cap 102 enclosing a single outlet electrical receptacle 104 and covering a center rectangular opening in the housing member 52. The end cap 102 may be a separate component or integral with the housing member 52. The receptacle 104 includes inwardly extending legs 106 attached to the side wall of the retractor reel by fasteners 108.

As shown in FIGS. 6 through 9, the power cord 38 of the retractor 14 is electrically connected with a pair of spring terminals 110 radially spaced about the rotation axis on the inner surface of the housing member 50. A pair of circular commutator rings 112 are mounted on the outer surface of the side wall 72 of the retractor reel and respectively engage the terminals 110. The commutator rings 112 are connected with the electrical terminals of the receptacle by lead wires 114 that extend axially through the hub of the reel, thereby establishing an electrical path from the power strip 36 to the receptacle 104.

The housing member 52 and the adjacent side wall of the wheel are provided with radially outwardly opening axially aligned mounting slots 120,122 respectively. The slot 120 terminates at a circular base wall 124 (FIG. 2).

To assemble the cord of the appliance on the retractor 14, a split circular grommet 126 is located on the appliance cord, as shown in FIG. 3. The grommet include a circumferential groove. The appliance cord is plugged into the receptacle 104, the grommet 126 fully inserted into the slot 122. The cord is then wound on the reel through the circumferential housing opening 54 (FIG. 2). After assembly, the operator may withdraw the cord for operative use of the appliance (FIG. 4). After completion, the cord is retracted as described above to the retracted parked position (FIG. 5).

In the assembled condition, the appliance cord and plug are clearly visible to the operator such that wear and tear and electrical complications can be clearly observed, in accordance with prevailing regulations. If the operator desires to change appliances, or move to another work site, the appliance may be safely disconnected in reverse order of the above steps. The resulting tool provides an approved assembly through the integration of rated and UL approved components.

It will be apparent that the cord retractor above described may be used for organizing the power cords of other electrical devices wherein it is desired to store the appliance on a support surface and provide retracting of the cord for operative uses.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claim.

What is claimed is:

1. A cosmetology tool organizer comprising: a cosmetology work station; a cosmetology appliance having an appliance cord terminating with a plug member; a base member for mounting on a vertical support surface at the work station; a retractor assembly having input cord for electrical connection with a power source, said retractor assembly including a base assembly and mounting means for attaching to said base member, a first housing member carried by said base assembly; a retractor reel rotatably supported by a shaft member on said first housing member, said retractor reel having a cylindrical hub axially bounded by radially outwardly extending first and second annular walls, commutator means between said first housing member and said first annular wall for establishing electrical connection with said input cord, said commutator means having electrical connection means at said first annular wall; a second housing member rotatably connected to said second annular wall of said retractor reel, said housing members having axially spaced cylindrical walls surrounding said reel member and forming a forwardly opening circumferential cord opening extending from about an upper vertical position to at least a bottom vertical position; latching means extending axially outward from said second annular wall cooperating between said shaft member and said reel member for establishing a latched condition and an unlatched condition in response to reel rotation; an outlet assembly connected to an exterior axially outwardly facing surface on said second housing member, said outlet assembly including a cover portion overlying said latching means and an outlet receptacle having input means interior of said cover portion and output means exterior of said cover portion for receiving said plug member of said appliance cord; lead means extending axially interior of said hub of said reel member and electrically connecting said electrical connection means of said commutator means with said input means of said receptacle; aligned radially outwardly opening slots formed in said second housing member and said second annular wall of said reel member, said appliance cord being assembled with said plug member in said outlet means in said receptacle and said appliance cord extending axially through said slots and circumferentially wrapped around said hub of said reel member with said appliance extending outwardly through said cord opening whereby said appliance may be moved outwardly from said housing to an extended position and said latched condition permitting operator movement of said cord within the confines of said cord opening, and inwardly to a retracted position in said unlatched condition adjacent said housing, and spring means for biasing said reel from said extended position to retracted position.

2. The cosmetology organizer as recited in claim 1 wherein said receptacle includes mounting legs connected to said second annular wall.

3. The cosmetology organizer as recited in claim 1 including a grommet member carried on said appliance cord and compressively received in said slot in said second housing member preventing relative movement of said appliance cord between said plug member and said second housing member.

4. The cosmetology organizer as recited in claim 1 wherein said mounting means comprises a detented sliding connection.

5. The cosmetology organizer as recited in claim 1 wherein said mounting means permits pivotal movement about a vertical axis between said retractor assembly and said work station.

6. The cosmetology organizer as recited in claim 1 wherein said cord opening spans a sector of at least 180° from said upper vertical position.

7. The cosmetology organizer as recited in claim 6 wherein said cord opening terminates rearwardly adjacent said base assembly and spans a sector of about 270°.

8. The cosmetology organizer as recited in claim 6 wherein said first housing member includes a notch in an upper front portion facing said cord opening between said housing members, said notch terminating at a lower horizontal surface for supporting said appliance cord and said appliance at said retracted position.

9. The cosmetology organizer as recited in claim 1 wherein said commutator means includes radially space spring contact members carried on an inner surface of said first housing member, and concentric annular contact rings carried on said first annular wall of said reel member and operative engaging said spring contact members to establish a rotating electrical connection therebetween.

10. A cord retractor for connection with an electrical cord of an electrical device including a cord terminating with a plug member, said retractor comprising: a base member for mounting on a support surface; an input cord on said base member for electrical connection with a power source, a first housing member carried by said base member; a shaft member carried on said first housing member; a retractor reel rotatably supported by said shaft member, said retractor reel having a cylindrical hub axially bounded by radially outwardly extending first and second annular walls; commutator means between said first housing member and said first annular wall for establishing electrical connection with said input cord, said commutator means having electrical connection means at said first annular wall; a second housing member rotatably connected to said second annular wall of said retractor reel, said housing members having axially spaced cylindrical walls surrounding said reel member and forming an extended circumferential cord opening; latching means extending axially outward from said second annular wall cooperating between said shaft member and said reel member for establishing a latched condition and an unlatched condition in response to reel rotation; an outlet assembly connected to an exterior axially outwardly facing surface on said second housing member, said outlet assembly including a cover portion overlying said latching means and an outlet receptacle having input means interior of said cover portion and output means exterior of said cover portion for receiving said plug member of the cord; lead means extending axially interior of said hub of said reel member and electrically connecting said electrical connection means of said commutator means with said input means of said receptacle; aligned radially outwardly opening slots formed in said second housing member and said second annular wall of said reel member whereby the device may be operatively connected with said reel with said plug member in said outlet means in said receptacle and said appliance cord extending axially through said slots and circumferentially wrapped around said hub of said reel member with said appliance extending outwardly through said cord opening whereby said appliance may be moved outwardly from said housing to an extended position and said latched condition permitting operator movement of said cord within the confines of said cord opening, and inwardly to a retracted position in said unlatched condition adjacent said housing, and spring means for biasing said reel from said extended position to retracted position.

* * * * *